United States Patent [19]

Tantardini

[11] Patent Number: 4,629,406

[45] Date of Patent: Dec. 16, 1986

[54] VOLUMETRIC VANE PUMP FOR FLUID-HYDRAULIC DRIVE

[75] Inventor: Paolo Tantardini, Milan, Italy

[73] Assignee: Atos Oleodinamica S.p.A., Milan, Italy

[21] Appl. No.: 699,246

[22] Filed: Feb. 7, 1985

[30] Foreign Application Priority Data

Feb. 10, 1984 [IT] Italy ..... 20811/84[U]

[51] Int. Cl.[4] ..... F04C 2/00

[52] U.S. Cl. ..... 418/268

[58] Field of Search ..... 418/259, 266–270

[56] References Cited

U.S. PATENT DOCUMENTS

| | | | |
|---|---|---|---|
| 2,056,910 | 10/1936 | Schauer | 418/268 |
| 3,008,424 | 11/1961 | Roth | 418/267 |
| 3,401,641 | 9/1968 | Adams | 418/268 |
| 3,574,493 | 4/1971 | Hamilton | 418/268 |
| 3,640,651 | 2/1972 | Johnson | 418/269 |
| 3,869,231 | 3/1975 | Adams | 418/268 |

*Primary Examiner*—Leonard E. Smith
*Assistant Examiner*—Jane E. Obee
*Attorney, Agent, or Firm*—Diller, Ramik & Wight

[57] ABSTRACT

Volumetric vane pump for fluid-hydraulic drive comprising a stator and a blade-bearing rotor, wherein each blade is pushed against the stator by a respective piston by the action of the delivery pressure of the pump, each piston having a diameter greater than the thickness of the related blade and a thrust axis lying along a symmetrical transverse plane of the blade and in a displaced position relatively to a longitudinal plane of the blade containing the rotation axis of the rotor, in advance relatively to the direction of rotation of the same rotor.

7 Claims, 3 Drawing Figures

VOLUMETRIC VANE PUMP FOR FLUID-HYDRAULIC DRIVE

The present invention relates to a volumetric vane pump for fluid-hydraulic drive.

Particular reference is herein made to pumps comprising a blade-bearing rotor housed within a suitably shaped cavity of a stator, closed by covers resting against the sides the same stator.

The covers provided with seal means for the hydraulic fluid and with orifices for the hydraulic connections for the inlet and the outlet of the fluid.

For the rotary drive of the rotor a shaft is provided going through the inside of the chamber constituted by the stator and by the covers, and constrained to the rotor.

During the rotation of the rotor, the blades extend outside it in radial direction, sticking to the inner profile of the stator, and generating chambers for the transfer of the fluid from the inlet area to the outlet areas, which are at pressure values different to each other.

For a correct efficiency of the pump it is important that in all stages, and under the various operating conditions (various rotation speeds, suction pressures, delivery pressure, etc.), the pressures acting on the blades be such as to allow the blades to adhere to the inner profile of the stator; and that during the passage of each blade in correspondence of the areas in which the difference of pressure between two adjacent transfer chambers is high, a torque should not be formed on the two opposite working surfaces of the blades, acting in the opposite direction relative to the rotation direction of the rotor, which would tend to deform the blade, causing an anomalous stress and local wear.

To the purpose of having the blades stuck to the stator, small pistons are used, each exerting a thrust applied to the base of a respective blade along a radial axis thereof. To this purpose, on each piston acts the delivery pressure of the pump through suitable ducts.

Such a solution however does not eliminate the drawback of the blade-deforming torque, in that all provided loads are radial. Moreover, the pistons have a diameter lower than the thickness of the blade, which limits the intensity of the thrust force on the blade, a continuous adhesion of the blades to the inner profile of the stator being thus not secured.

The purpose of the present invention is to provide a pump structure of the above described type, allowing the said drawbacks to be eliminated.

Such a purpose is achieved by providing a volumetric vane pump for fluid-hydraulic drive, comprising a body containing a stator, within a cavity of which a blade-bearing rotor is housed so at to be capable of rotating around a rotation axis, said rotor bearing an annular set of blades, each one of which is radially slid; and inside a corresponding slot of the rotor along a longitudinal plane of its own containing the rotor rotation axis and bearing an annular set of small pistons, which slide within corresponding cylindrical seats, each of them, by the action of the delivery pressure of the pump, applying a thrust pushing a respective blade out of the rotor against an annular profile of the stator cavity, characterized in that each piston has a diameter greater than the thickness of its respective blade, and correspondingly the cylindrical seat of each piston has a diameter greater than the width of the slot of the respective blade, each piston having a thrust axis lying along a symmetrical transverse plane of the blade, and being displaced relative to said longitudinal plane of the blade, in retarded position relatively to the rotation direction of the rotor.

In order to allow a better comprehension of the characteristics and advantages of the present invention, hereunder an exemplifying and not limiting embodiment is disclosed, and illustrated in the drawing attached, wherein.

Figure 1:
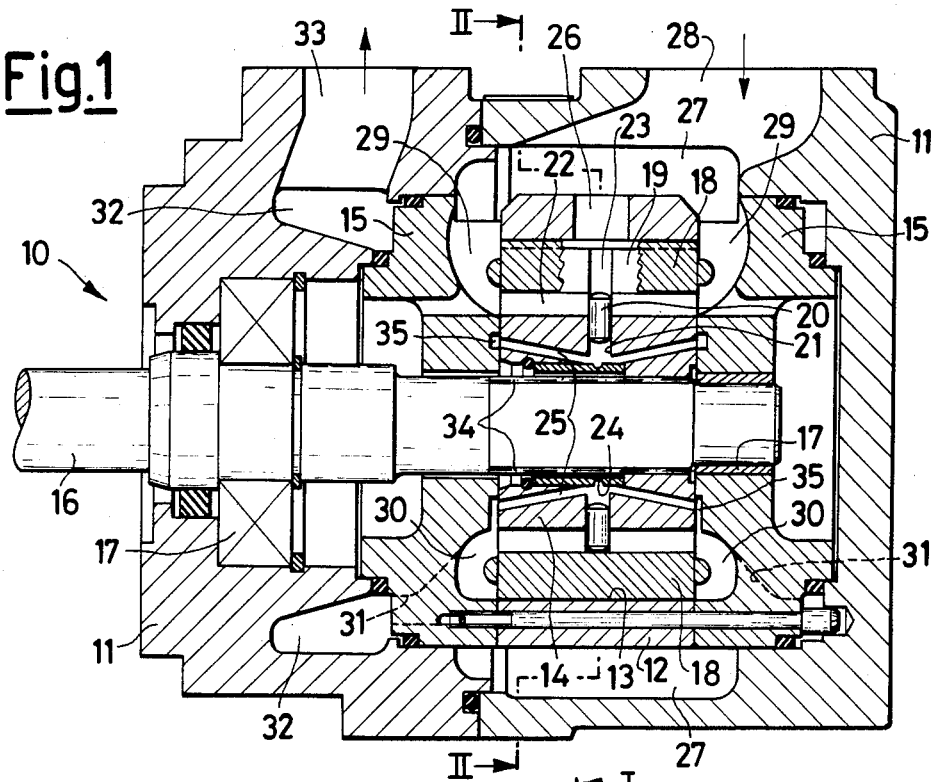
FIG. 1 shows a pump according to the invention in longitudinal section along the line I—I of FIG. 2.

The pump 10, comprises a composite body 11, enclosing a fixed cylindrical stator 12, a cylindrical rotor 14 being housed within an oval-shaped cavity 13 of said cylindrical stator 12. To the two sides of the stator 12 two respective covers 15 are fastened, forming together with the cavity 13 a containment casing for the rotor 14.

To supply rotary motion to the rotor 14, there is provided a shaft 16 going through the body 11 and the covers 15, said shaft being mounted on bearings 17 and being constrained to rotate together with the rotor 14 in a suitable way as it will be shown later.

Figure 2:
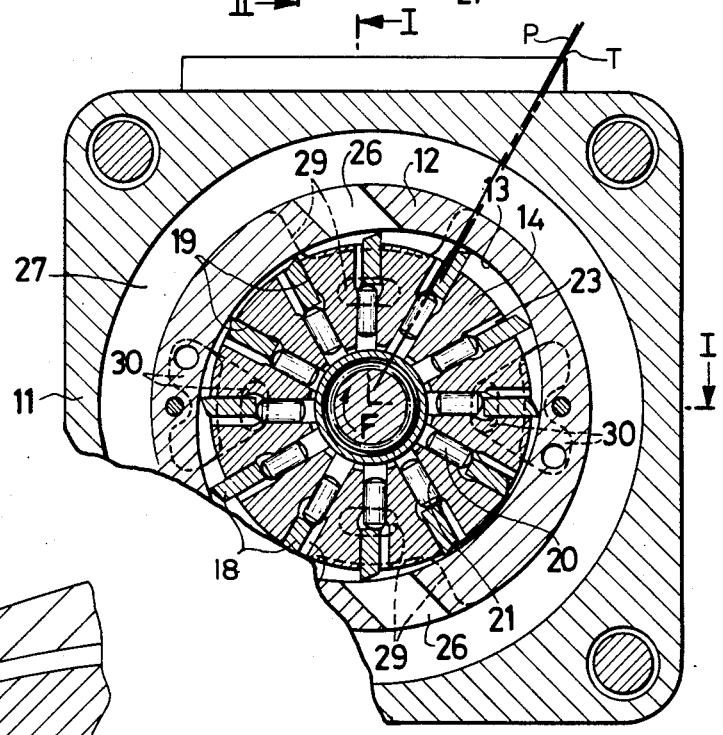
FIG. 2 shows the said pump in cross section along the line II—II of FIG. 1.
Figure 3:
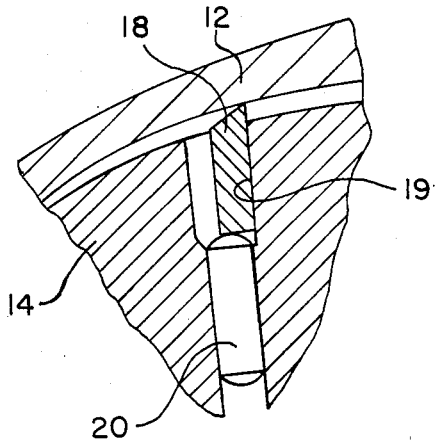
FIG. 3 is an enlarged fragmentary sectional view and illustrates one of the pistons and its relationship to its associated blade.

The rotor 14 bears an annular set of radial blades 18. Each blade 18 is slidingly housed within a corresponding slot 19 of the rotor 14. Onto the base of each blade 18 a small thrust piston 20 is active, slidingly housed within a corresponding cylindrical seat 21 of the rotor 14. The piston 20 and its cylindrical seat 21 have a diameter respectively greater than the thickness of its related blade 18 and the width of the related slot 19. The piston 20, moreover, acts on the related blade 18 along an axis P (FIG. 2) contained in a transverse plane of symmetry of the blade (FIG. 1), but in displaced relationship relative to a longitudinal plane T (FIG. 2) of the blade containing the rotation axis of the rotor, and in lagging relationship to the longitudinal plane T in the direction of rotation of the rotor (FIG. 2). The cylindrical seat 21 of each piston 20 ends in an enlarged bottom portion 22 suitable to receive the bottom of the respective blade 18. The cylindrical seat 21, thanks to the fact of having a diameter greater than the width of the slot 19 of the blade 18, continues then, in its section exceeding such width, into a semicylindrical channel 23 provided on a wall of the same slot 19 and leading to the outside of the rotor 14 into the cavity 13. At their inner ends, the seats 21 of the pistons 20 communicate with each other through a common annular cavity 24 of reduced section relative to the seat 21, for each seat 21 are moreover provided two channels 23, always of reduced section, diverging from the seat 21 in correspondence of said common cavity 24 to join the delivery of the pump, as it will be seen later.

In the stator 12 in two diametrically opposite positions two passages 26 are provided, connecting the inner cavity 13 of the same stator with an annular outer cavity 27 of the body 11, said cavity 27 communicating in its turn with a fluid inlet port 28 of the body 11. In corresponding positions, in the covers 15 slots 29 are provided communicating with the cavity 27, and opening at the level of the bottom portion 13 and of the cavity 22, to the purpose of hydraulically connecting all said cavities. In two diametrically opposed positions, at 90° relative to the positions of the passages 26 and of the slots 29, slots 30 are provided in the covers 15, opening at the level of the cavity 13 and of the bottom portions 22, and communicating, through passages 31, with an annular chamber 32 of the body 11 in connection with a fluid outlet port 33 of the body 11. With the slots 30 are in constant communication with the channels 25 through annular passages 35 of the covers 15.

The oval-shaped profile of the cavity 13, and the positioning of the cavities opening into it are such that, during the rotation of the rotor 14 in the direction of the arrow F of FIG. 2, when the blades 18 travel in front of the passages 26 and the slots 29, the chambers defined by them are in stage of volumetric expansion, so as to intake fluid from the inlet port 28, whilst when the blades 18 are travelling in front of the slots 30, the chambers defined by them are in stage of volumetric decrease, so as to deliver pressurized fluid towards the outlet port 33.

The structure disclosed causes an optimum distribution of the loads acting on each blade 18.

In fact, each piston 20, onto which the delivery pressure is acting through the channels 25, exerts an effective thrust on the related blade 18, in that it has a high thrust section, relative to the pistons of known pumps, which has been demonstrated to allow a perfect and continuous adhesion of the same blade against the wall of the cavity 13. Moreover, the said displaced position of the piston 20 relative to the related blade 18, with the advance described, allows a torque to be applied to the same blade, counteracting the deforming torque, mentioned in the introduction, acting in the opposite direction relative to the rotation direction of the rotor 14.

The channels 23, as they place the cavity 13 in communication with the bottom portions 22 of the cavities 19, allow the pressure existing within the chambers defined by the blades 18 to be supplied to the bottom of the said blades, so as to have an optimum balancing of the hydraulic pressures acting on the head and on the bottom of each blade. This is achieved, for each channel 23, by an extension of the seat 21 of the piston 20 a single drilling is therefore constructionally sufficient for creating the seat of the piston and the channel for balancing the radial hydraulic pressures, contrary to what happens in the known pumps wherein, to the purpose of the said hydraulic balancing, a particular precision drilling is necessary in the rotor or in the blade.

The cavity 24 and the channels 25, of reduced section, lead to a further advantage. They indeed create a bottleneck against the flow of the fluid when this is pushed rearwards by the pistons 20 during their reverse stroke, so as to create a hydraulic damping. The cavity 25, in particular, allows a soft and controlled impact of each piston in the extreme portion of its stroke, wherein it progressively obstructs, with its side walls, the two channels 25 diverging from its seat 21, and the fluid hence tends to flow down via the same cavity only, as it can be understood by observing FIG. 1.

The pump 10 can be used for opposite rotation relatively to the direction indicated, by reversing the rotor 14 on the shaft 16 by 180° about an axis transverse relative to the same shaft. For this purpose the shaft 16 and the rotor 14 are rigidly coupled for, rotation by means of a toothed coupling 34. In order to make it possible to effect such rotor reversal, the sum of the axial lengths of both the toothing of the shaft 16 and the toothing of the rotor 14 is greater than the overall axial length of the rotor 14. Thus, the sum of the axial values of such lengths is greater than the total axial length of the rotor 14. In such a way, both in the position as shown in the figures, and in the reversed position, the toothing of rotor 14 is in any case at least partly overlapping to the toothing of the shaft 16, so as to provide the coupling of them for joint rotation.

In the present embodiment, reference is made to a vane pump with constant delivery rate, with fixed stator, but the same novel concepts may be applied to a movable-stator vane pump with variable delivery rate, by means of modifications which will be obvious for those skilled in the art.

I claim:

1. A volumetric vane pump for fluid-hydraulic drive comprising a body having a stator cavity containing a stator, a rotor mounted for rotation about an axis within said stator, said rotor carrying a plurality of generally radially disposed blades, said blades being each slidably received in an associated slot of said rotor, each blade having a longitudinal plane disposed generally radially relative to said rotor, a bore positioned radially of and opening into each slot, a piston in each bore for urging each associated blade radially outwardly against an inner annular surface of said stator, each bore and piston having a diameter greater than the thickness and width of its associated respective blade and slot, said blade and slot having essentially the same width, each piston having an axis passing through said rotor axis, said rotor being rotatable in a predetermined direction of rotation, and each said piston axis being in lagging relationship to its associated blade longitudinal plane relative to the direction of rotor rotation.

2. The pump as defined in claim 1 wherein a portion of each said bore merges into and forms an enlarged portion of each associated slot, and a channel formed in each slot extends from its associated bore enlarged portion generally radially outwardly opening into said stator cavity.

3. The pump as defined in claim 1 includes duct means associated with each bore for placing each bore in fluid communication with a fluid input cavity of said body, and each said duct means is of reduced section relative to the section of its associated bore.

4. The pump as defined in claim 1 including a shaft for said rotor, means for coupling said rotor to said shaft, said shaft having an axial length, said rotor having an axial length, said coupling means extending axially along both said rotor and shaft, and the sum of the axial lengths of both said coupling means being greater than the overall axial length of said rotor.

5. The pump as defined in claim 1 including duct means associated with each bore for placing each bore in fluid communication with a fluid input cavity of said body.

6. The pump as defined in claim 5 wherein said duct means includes an annular cavity of said rotor in fluid communication with radially inner ends of all of said bores.

7. The pump as defined in claim 11 wherein said duct means includes at least one generally axially disposed channel in said rotor extending between said annular cavity and an axial face of said rotor.

* * * * *